US005624031A

United States Patent [19]

Fowler et al.

[11] Patent Number: 5,624,031

[45] Date of Patent: Apr. 29, 1997

[54] TRAY CONSTRUCTION AND METHOD OF CONSTRUCTING

[75] Inventors: James L. Fowler, Sapulpa, Okla.; Charles E. Wood, Arlington, Tex.

[73] Assignee: Green Bay Packaging, Inc., Green Bay, Wis.

[21] Appl. No.: 504,699

[22] Filed: Jul. 20, 1995

[51] Int. Cl.[6] ..... B65D 85/66; B65D 5/30; B31B 1/50

[52] U.S. Cl. ..... 206/391; 206/497; 206/557; 229/101; 229/196; 493/137

[58] Field of Search ..... 206/391, 386, 206/600, 497, 503, 557; 229/101, 196, 197; 493/137

[56] References Cited

U.S. PATENT DOCUMENTS

| | | | |
|---|---|---|---|
| 432,475 | 7/1890 | Brown | 229/196 |
| 1,423,272 | 7/1922 | Steudel | 229/101 |
| 1,462,009 | 7/1923 | Higginson | 229/196 |
| 2,988,259 | 6/1961 | Callinicos | 229/101 |
| 3,371,842 | 3/1968 | Hechtmann et al. | 229/101 |
| 3,442,436 | 5/1969 | Kirby, Jr. | 206/557 X |
| 3,455,499 | 7/1969 | Anderson | 229/101 |
| 4,444,311 | 4/1984 | Rias | 206/391 |
| 4,998,619 | 3/1991 | Sowa et al. | 206/392 |
| 5,192,019 | 3/1993 | Meehan | 229/101 |

*Primary Examiner*—Bryon P. Gehman
*Attorney, Agent, or Firm*—Andrus, Sceales, Starke & Sawall

[57] ABSTRACT

A tray-type package for receiving a series of articles is constructed from a blank which enables the user to vary the size of the horizontal surface on which the articles are placed. The blank includes a bottom panel and a series of side walls which are interconnected with the bottom panel via connection structure which defines a series of fold locations, and the user selects the appropriate fold location according to the size of articles being packaged such that, when a predetermined number of articles are placed on the tray, the outer articles are in close proximity to, or engage, the tray side walls. When the tray side walls are folded at the different fold positions, the position of the adjacent side wall ends varies, and retainer structure is interposed between the side wall ends which accommodates such variation and which secures the side walls together. The retainer structure is an extension section formed on one of the side walls which overlaps the other side wall. The extension section includes tab structure receivable within one of a series of slots formed in the other side wall, for interconnecting the side walls.

17 Claims, 4 Drawing Sheets

FIG. 1
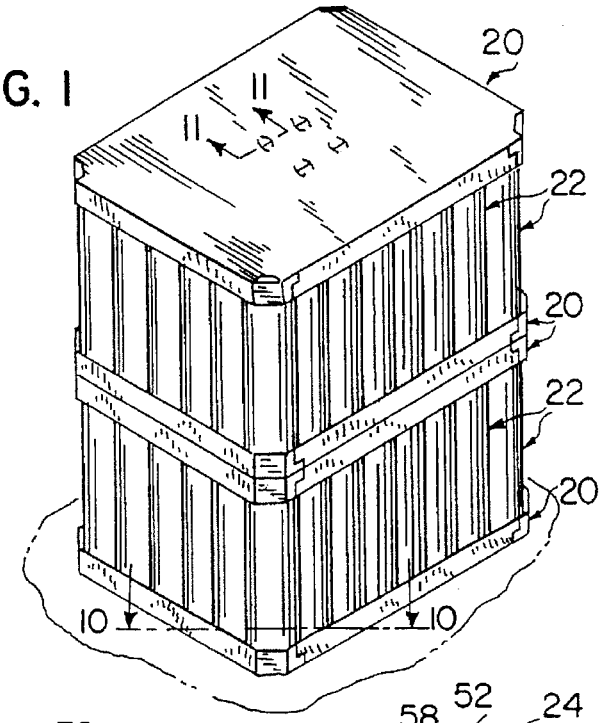
FIG. 11
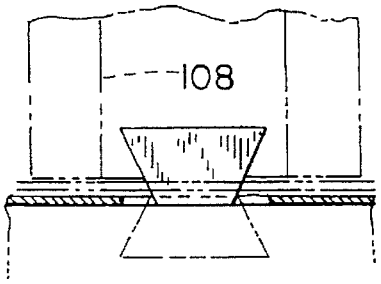
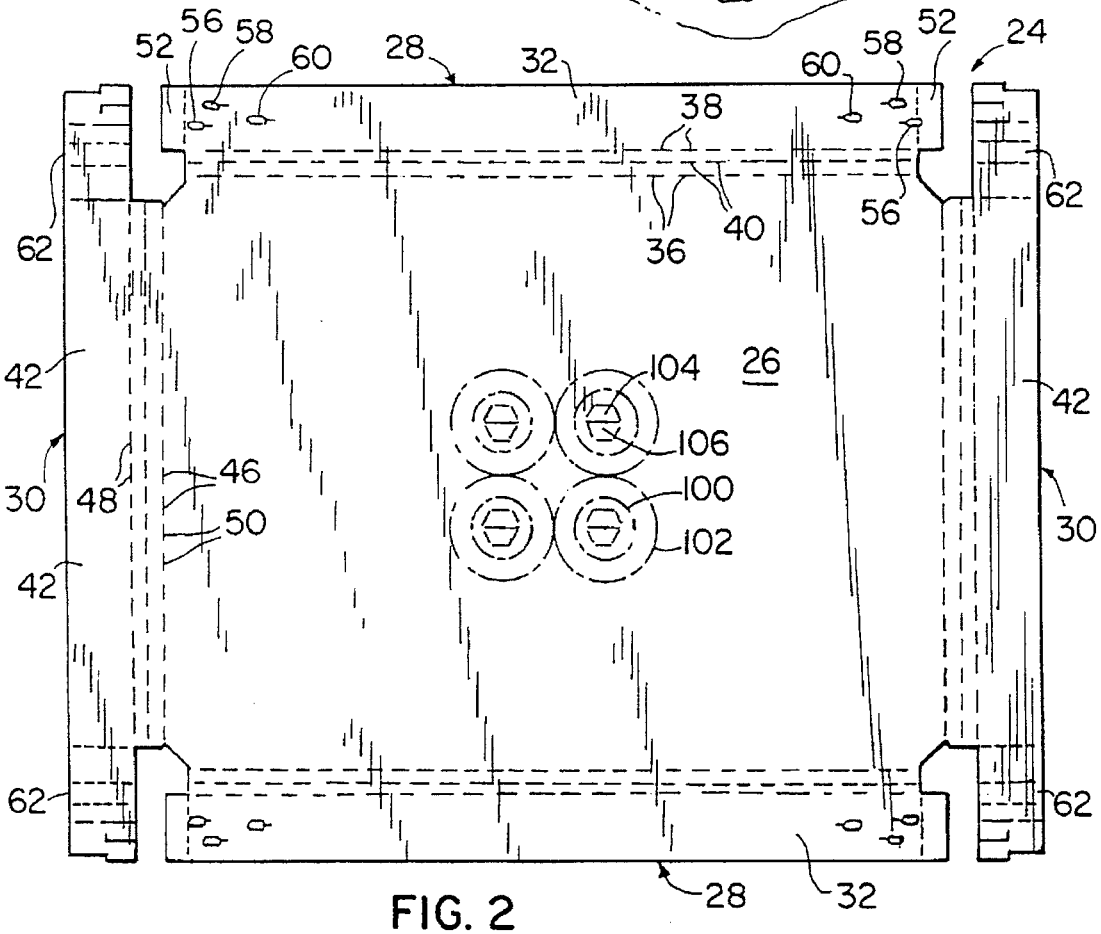
FIG. 2

FIG. 3
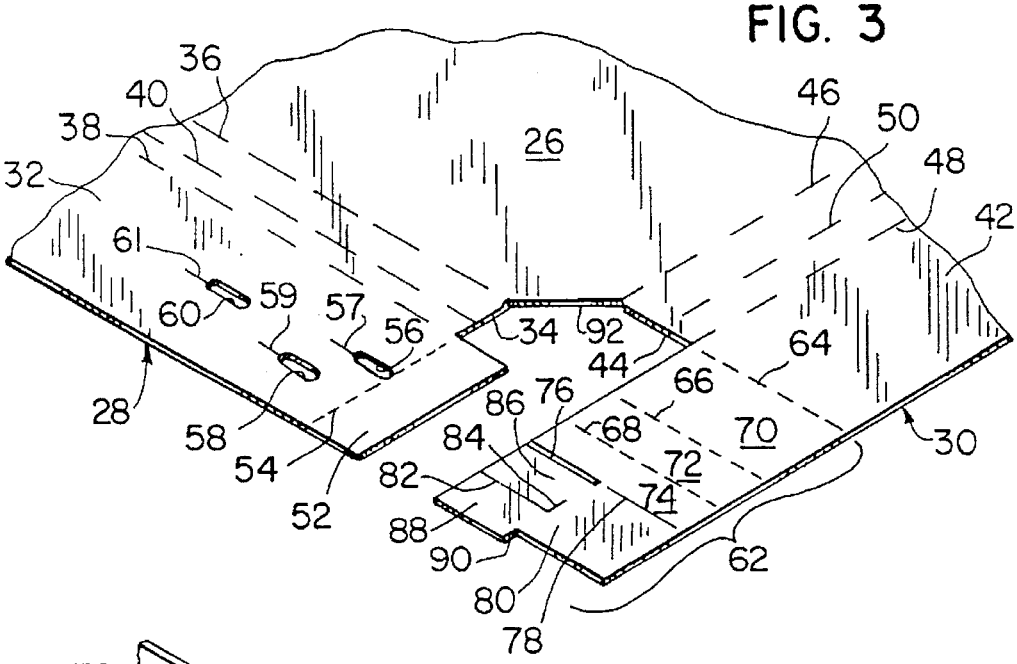
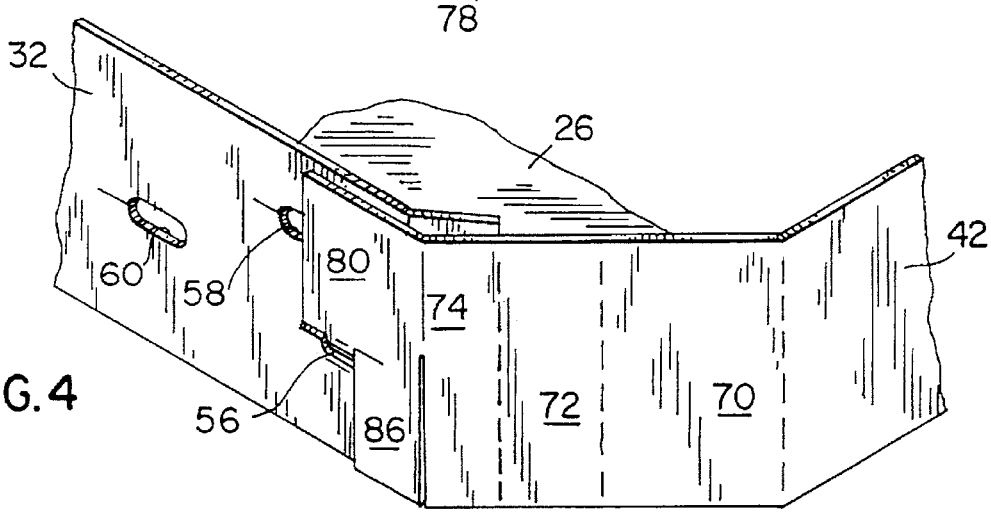
FIG. 4
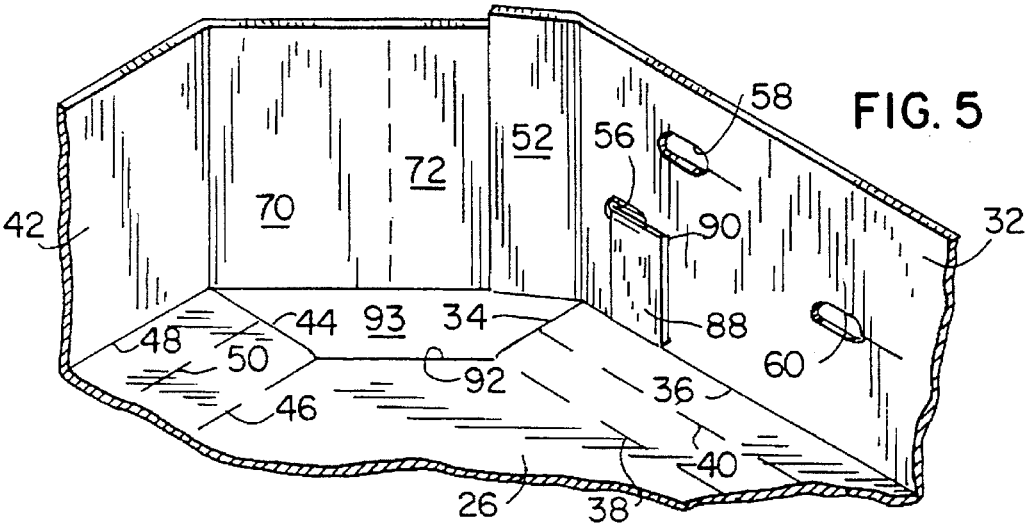
FIG. 5

FIG. 6
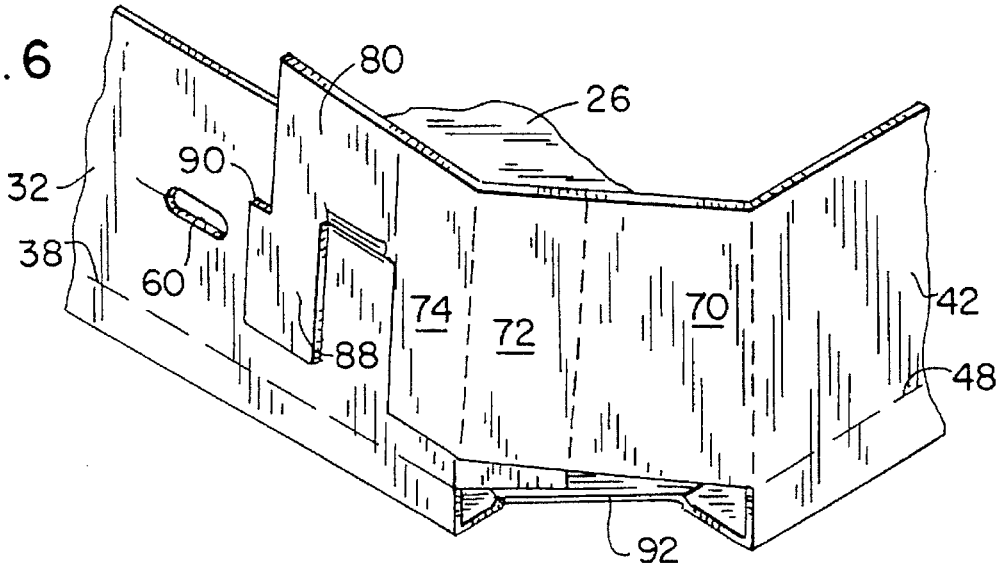
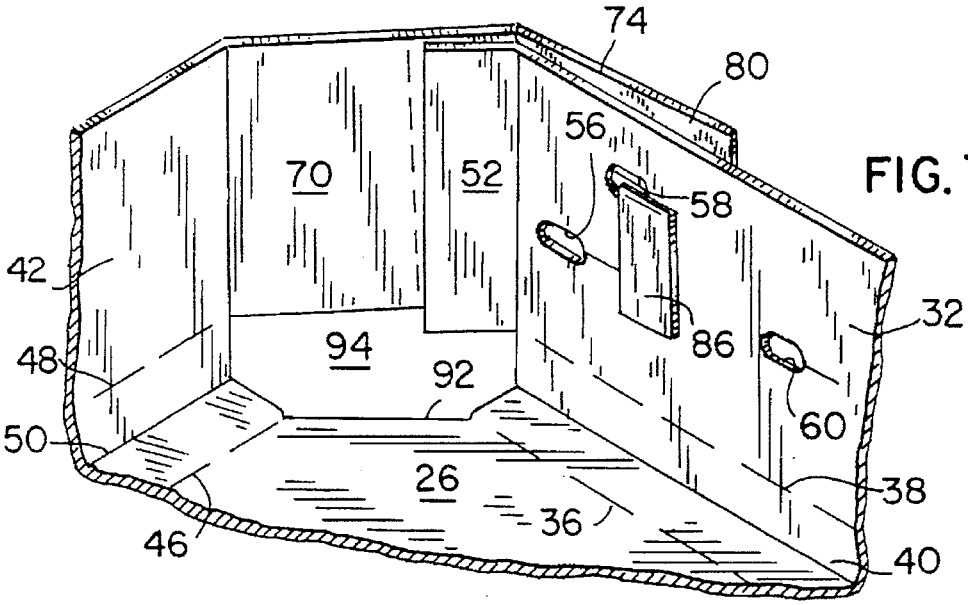
FIG. 7
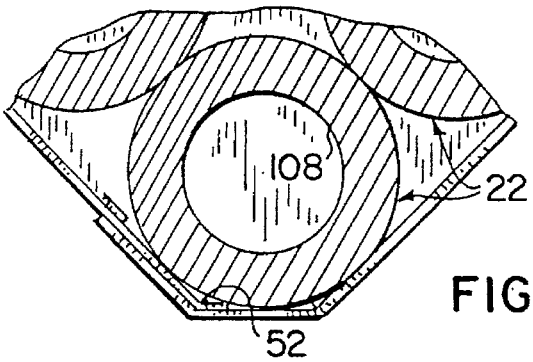
FIG. 10

TRAY CONSTRUCTION AND METHOD OF CONSTRUCTING

BACKGROUND OF THE INVENTION

This invention relates to a tray construction, and more particularly to a tray which can be constructed to different sizes according to the size of articles being packaged on the tray.

Tray-type packages are often used to hold a series of articles during storage or shipment. A typical tray includes a bottom panel and a series of upstanding side walls, which define a cavity or recess within which articles are placed. The cavity is sized such that, when the cavity is filled with the articles being packaged, each article is in abutting relationship with adjacent articles and the outermost articles are located closely adjacent, or in engagement with, the tray side walls. In some applications, once the tray is filled with articles in this manner, another tray is placed over the top of the articles. One or more additional layers of articles packaged in this manner are placed on top of the first set of packaged articles, and the layers are then wrapped using an external film-type wrapping device to secure the layers together prior to shipment.

This type of article packaging arrangement works well for a predetermined size of article, in that the tray is dimensioned to receive a predetermined number of articles in abutting engagement with each other. However, if the size of the articles being packaged varies from the predetermined size, it is necessary to provide a differently dimensioned tray in order to maintain the articles in the desired abutting relationship with each other.

It is an object of the present invention to provide a tray construction in which the size of the tray cavity can be varied according to the size of the articles being packaged on the tray. It is a further object of the invention to provide such a tray which is constructed on-site by an operator by folding portions of a tray blank to form the side walls, with the side walls being formed according to the article size. It is a further object of the invention to provide such a tray which is relatively simple in its manufacture and construction, yet which provides a high degree of flexibility for packaging differently sized articles.

In accordance with the invention, a tray construction includes a bottom panel and a series of side portions which extend from the bottom panel. The side portions define ends, and are foldable relative to the bottom panel to two or more fold positions such that at least a part of each side portion defines a side wall extending upwardly from the bottom wall. The ends of adjacent side portions are located adjacent each other when the side portions are folded relative to the bottom panel, and folding of the side portions to different fold positions varies the position of adjacent side portion ends relative to each other. Retainer structure secures the folded side portions together toward the side portion ends when the side portions are folded, and the retainer structure is capable of accommodating variations in the position of adjacent side portion ends when the side portions are folded to their different fold positions. Each side portion includes a series of pre-formed fold lines which define the different fold positions. The area of the side portion in which the fold lines are formed defines a connector section between the bottom panel and the area of the side portion which defines the side wall when the side portion is folded relative to the bottom panel. A first one of each pair of adjacent side portions includes an extension which overlaps the end of the adjacent second side portion, and the retainer structure is interposed between the extension and the second side portion. The amount of overlap of the extension with the second side portion varies according to the fold positions of the side portions. The retainer structure is preferably in the form of a tab and slot arrangement associated with the extension and the second side portion. The extension includes a tab, and one or more spaced slots are formed toward the end of the second side portion. The slots are laterally spaced from each other relative to a longitudinal axis defined by the second side portion, and the slots are also preferably spaced from each other relative to an axis transverse to the longitudinal axis. This construction enables the operator to secure the first and second side portions together according to the size of the articles being packaged. The transverse offset of the slots relative to each other provides a visual indication to the operator as to the construction of the side walls and thereby the size of articles packaged. The connector section, which includes the two or more fold lines, provides folding in several locations. In one fold location, an inner portion of the connector section between the fold and the bottom panel is coplanar with the bottom panel. In another fold position, an outer portion of the connector section between the fold and the side wall is coplanar with the side wall.

The invention further contemplates a method of constructing a tray, substantially in accordance with the foregoing summary. The invention also contemplates a method of packaging a series of articles on a tray, in which the articles are substantially equally sized and are selected from two or more distinct sizes of articles, also substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view showing two layers of elongated roll-type articles packaged using trays constructed according to the present invention;

FIG. 2 is a top plan view of a blank from which the trays of FIG. 1 are constructed;

FIG. 3 is an enlarged partial isometric view showing a corner portion of the bottom panel of the tray blank of FIG. 2 and the ends of a pair of adjacent side portions;

FIG. 4 is a partial isometric view showing a corner portion of the tray construction of FIG. 1 to accommodate articles having a first predetermined size;

FIG. 5 is a reverse isometric view of the constructed tray construction of FIG. 4;

FIG. 6 is a partial isometric view similar to FIG. 4, showing the tray construction to accommodate articles having a second predetermined size;

FIG. 7 is a reverse isometric view of the tray construction of FIG. 6;

FIG. 10 is a partial section view taken along line 10—10 of FIG. 1; and FIG. 11 iS a partial section view taken along line 11—11 of FIG. 1.

DETAILED DESCRIPTION OF THE INVENTION

Figure 8:
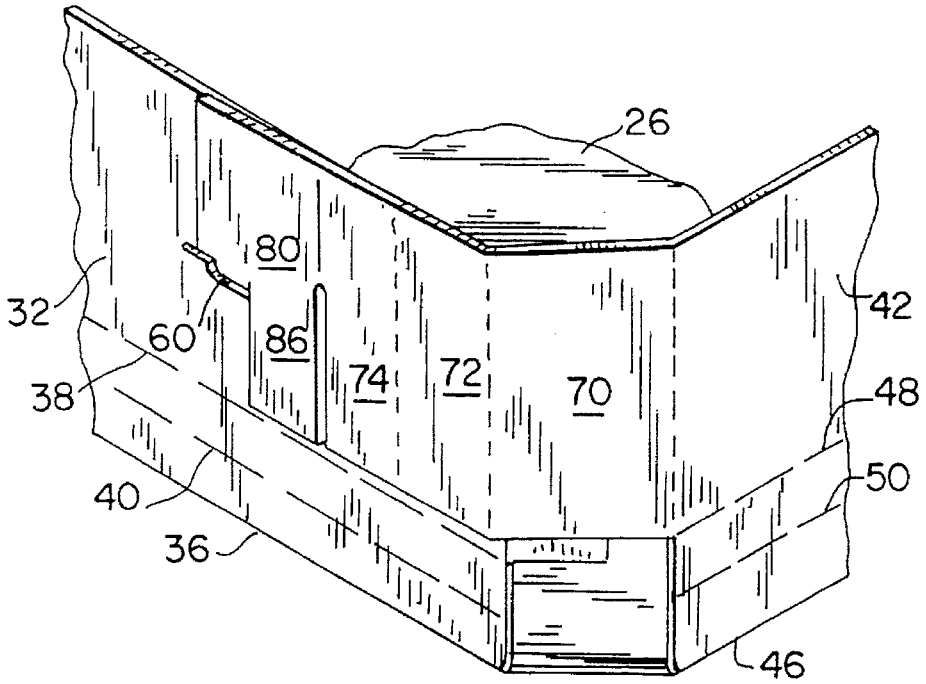
FIG. 8 is a partial isometric view similar to FIGS. 4 and 6, showing the tray construction to accommodate articles having a third predetermined size.

FIG. 1 illustrates a series of trays 20 constructed according to the invention for packaging layers of articles 22. Trays 20 are identical in construction; for each layer of packaged articles 22 a lower tray 20 provides the base for the layer and an upper tray 20 provides a cap for the layer, with the base and cap trays 20 engaging the lower and upper ends, respectively, of articles 22.

As illustrated, articles 22 are in the form of elongated cylindrical articles, such as plastic film wrapped about a core. It is understood, however, that trays 20 could be used to package any type of articles, and are not limited to articles having the particular shape of articles 22.

FIG. 2 illustrates a blank 24 used to construct trays 20. Blank 24 includes a bottom panel 26, a first pair of side portions 28, and a second pair of side portions 30. Each of side portions 28 and 30 is symmetrical about a centerline extending along a transverse axis perpendicular to the longitudinal axis of the side portion.

Referring to FIGS. 2 and 3, each side portion 28 includes a side wall section 32 and a connector section 34 disposed between side wall section 32 and bottom panel 26. Connector section 34 has a width defined by parallel inner and outer demarcations, such as sets of perforations 36, 38, respectively, such that inner perforations 36 define the edge of bottom panel 26 and outer perforations 38 define the edge of side wall section 32. A third, intermediate demarcation in the form of a set of perforations 40 is located between inner and outer perforations 36, 38. Perforation sets 36–40 are parallel and linear, and each defines a location at which side wall section 32 can be folded relative to bottom panel 26.

Similarly, each side portion 30 includes a side wall section 42 and a connector section 44 disposed between side wall section 42 and bottom panel 26. Connector section has a width defined by parallel inner and outer demarcations, such as sets of perforations 46, 48, respectively, such that inner perforations 46 define the edge of bottom panel 26 and outer perforations 48 define the edge of side wall section 42. A third, intermediate demarcation in the form of a set of perforations 50 is located between inner and outer perforations 46, 48. Perforation sets 46–50 are parallel and linear, and each defines a location at which side wall section 42 can be folded relative to bottom panel 26.

Side wall section 32 includes tabs 52 which extend from its ends. Each tab 52 is bendable at a score line or perforation 54 defining the end of side wall section 42, which extends perpendicularly from the outer edge of side wall section 32 in line with the end of connector section 34. In addition, side wall section 32 includes slots 56, 58 and 60 toward its ends. Parallel slits 57, 59 and 61 extend inwardly from the inner ends of slots 56, 58 and 60, respectively. Slots 56, 58 and 60 are spaced from each other in a direction along the longitudinal axis of side wall section 32, and are also spaced from each other in a direction along a transverse axis perpendicular to the longitudinal side wall axis. Slots 56, 58 and 60 are thus axially and transversely staggered relative to each other and to the perpendicular axes of side wall section 32.

An extension sections 62 are formed integrally with side wall section 42, extending outwardly from its ends. Each extension section 62 includes a series of transverse perforations 64, 66 and 68 which define corner sections 70 and 72. An additional corner section 74 is located outwardly of corner section 72, and is defined by perforation 68 in combination with a slot 76, which extends transversely approximately half way through extension 62, and a colinear slit or score 78 having one end which terminates inwardly of the edge of extension section 62 and another end which terminates at a location slightly spaced from the inner terminus of slot 76. A locking section 80 is located outwardly of corner section 74, being defined between the outer end of extension section 62 and slot 76 in combination with slit or score 78. An L-shaped slit, defined by a pair of perpendicular slits 82 and 84, extends from the inner edge of extension section 62 and cooperates with slot 76 to define an inner locking tab 86. An outer locking tab 88 is defined between slit 82 and the outer edge of extension section 62. Inner locking tab 86 includes a shoulder defined by slit 84, and similarly extension section 62 is formed so as to define a shoulder 90 on locking tab 88.

It can be appreciated that a notch is formed in the sheet of material from which blank 24 is constructed so as to define the inner, facing edges of extension section 62 and tab 52, as well as the edges of connector sections 34, 44, the lower edge of tab 52 and the corner edge of bottom wall 26, shown in FIG. 3 at 92. This notch, along with the various slits, scores, perforations and other cuts, are formed in the blank sheet of material in accordance with conventional technology to construct blank 24. Preferably, blank 24 is formed from a sheet of material such as corrugated board, but it is understood that any other satisfactory material could be employed.

FIGS. 4–9 illustrate blank 24 constructed to its various tray-type configurations for accommodating differently sized articles, in a manner to be explained.

FIGS. 4 and 5 show a low-wall construction maximizing the available horizontal surface for supporting articles. To construct the tray of FIGS. 4 and 5, side portions 28 are folded upwardly at perforations 38 and side portions 30 are folded upwardly at perforations 48, such that side walls 32 and 42 are substantially perpendicular to bottom panel 26. When so folded, the portions of connector sections 34 and 44 between perforations 38, 48, respectively, and bottom panel 26 form an extension to bottom panel 26. Tab 52 engages and overlaps corner section 74, and outer locking tab 88 is inserted through slot 56 utilizing slit 57. Slot 56 and slit 57 cooperate to define a width slightly larger than that of tab 88, such that tab 88 can be slid through slot 56 and slit 57 until tab shoulder 90 has passed through slit 57 to attain its locking position of FIG. 5. In this position, tab 88 extends downwardly. Once shoulder 90 has passed through slit 57 and tab 88 positioned downwardly as shown in FIG. 5, the neck of tab 88 is disposed within slot 56 and tab 88 cannot be withdrawn back through slot 56 and slit 57. This functions to securely lock side walls 32 and 42 together. In this position, corner sections 70 and 72, in combination with the overlapping of corner section 74 with tab 52, define an angled corner wall which extends between side walls 32 and 42. A space 93 is located inwardly of the corner wall and is defined by the edges of connector sections 34, 44, corner edge 92 and the lower edges of corner sections 70–74 and tab 52. In this position, the upper edge of locking section 80 is located below the upper edges of side wall section 32 and tab 52. This provides the operator with a visual indication as to the size of the tray-type package so constructed, and thereby the size of the articles contained therein.

FIGS. 6 and 7 show blank 24 constructed to provide a tray-type package having an intermediate wall height. In this construction, side portions 28 and 30 are folded at perforations 40 and 50, respectively, extending substantially perpendicularly to bottom wall 26. In this position, the portion of connector section 34 between perforations 38 and 40 forms an extension of side wall section 32, and the portion of connector section 34 between inner perforation 36 and intermediate perforation 40 defines an extension of bottom wall 26. Similarly, the portion of connector section 44 between outer perforation 40 and intermediate perforation 50 defines an extension of side wall section 42, and the portion of connector section 44 between inner perforation 46 and intermediate perforation 50 defines an extension of bottom panel 26.

After side portions 28 and 30 are folded in this manner, tab 52 engages and overlaps corner section 72, and corner section 74 and locking section 80 overlap the end of side wall 32. Inner locking tab 86 is inserted through slot 58 and its associated slit 59, such that the neck of locking tab 86 is received within slot 58 in the same manner as described previously. This functions to secure side walls 32 and 42 together, with corner section 70 and tab 52 in combination with corner section 72 forming an angled corner between walls 32 and 42. A space 94 is formed below the corner wall, and again is defined by corner edge 92 in combination with the edges of connector sections 34, 44 and the lower edges of tab 52 and corner sections 70 and 72.

When locking tab 86 is engaged within slot 58 as shown and described, the upper edge of extension section 62 is disposed above and at an angle to the upper edge of side wall 32. This provides the operator with a visual indication as to the size of the tray-type package so constructed, and thereby the size of the articles contained therein.

Figure 9:
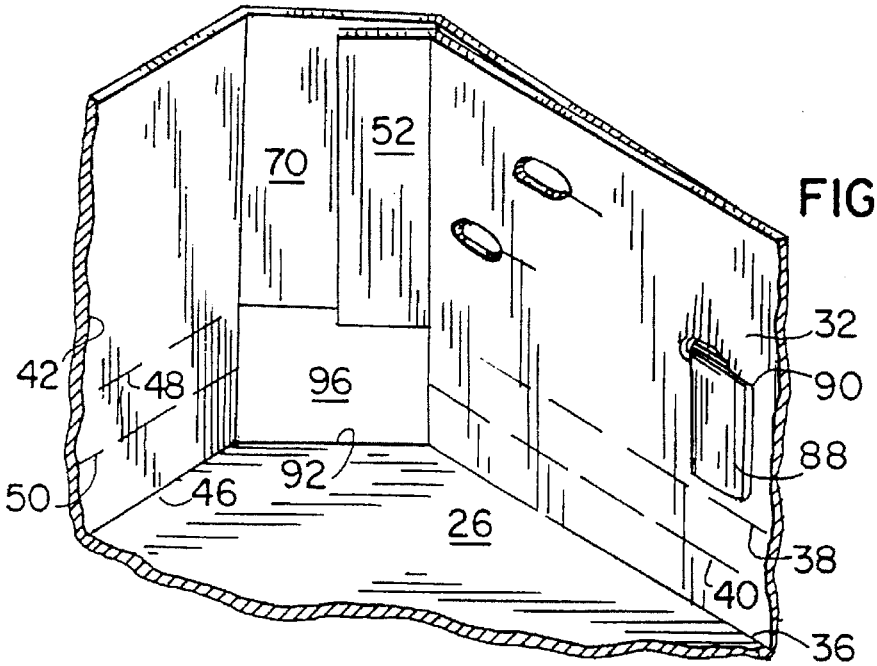
FIG. 9 is a reverse isometric view of the tray construction of FIG. 8.

FIGS. 8 and 9 illustrate a maximum wall height tray-type package formed by folding side portions 28 and 30 about inner perforations 36 and 46, respectively. When side portions 28 and 30 are folded in this manner, the portions of connector sections 34 and 44 between inner perforations 36, 46 and outer perforations 38, 48, respectively, form extensions of side walls 32, 42, respectively. This provides a tray construction in which the available horizontal surface area for placement of articles is minimized.

After side portions 28 and 30 are folded in this manner, outer locking tab 88 is inserted through slot 60 and its associated slit 61, in the same manner as described previously, to interconnect side walls 32 and 42. In this position, end tab 52 engages corner section 70, which in combination defines an angled corner wall extending between side walls 32 and 42. An opening 96 is defined below the corner wall so formed, and is bordered by corner edge 92 in combination with the edges of connector sections 34, 44 and the lower edges of corner section 70 and tab 52.

When blank 24 is constructed in this manner, the upper edge of extension section 62 is oriented at a downward angle relative to the upper edge of side wall 32, with its outer end being disposed below the upper edge of side wall 32. Again, this provides to the user a visual indication as to the size of the tray-type package and the size of the articles contained therein.

To package articles, such as rolls 22, an operator first ascertains the size of articles being packaged. Typically, one predetermined size of articles is being produced or is otherwise waiting to be packaged, and the operator then determines the size of the tray to be constructed according to the size of the "foot print" of the packaged articles. Once the operator determines the size of the articles being packaged, the operator can construct blank 24 to one of the three desired tray configurations, as set forth above. After tray has been constructed, the operator begins placing articles 22 on lower panel 26 beginning at the center of lower panel 26. To this end, the central portion of bottom panel 26 includes scores or other indicia which indicate the position at which the central articles 22 are to be located. Referring to FIG. 2, concentric circular scores 100, 102 are formed on bottom panel 26, and are arranged such that outer scores 102 contact each other and are symmetrical about both axes of bottom panel 26. The operator continues placing articles 22 on bottom panel 26 so as to form linear columns and rows which are parallel to both axes of bottom panel 26. The outermost articles 22 engage the inner surfaces of side walls 32 and 42, or are very closely spaced therefrom, and in any event side walls 32 and 42 are sufficiently close to the outermost articles 22 so as to prevent the article rows and columns from shifting or sliding relative to each other.

When articles of predetermined different sizes are being packaged, the operator selects a different fold location for side portions 28 and 30 for accommodating the predetermined number of rows and columns of such articles.

After the tray is fully loaded with articles 22, another tray is constructed in the same manner and is placed over the top of the articles as a cap. Referring to FIG. 11, H-slits are formed in the center of each inner score 100 to define a pair of tabs 104, 106. Tabs 104 and 106 are depressed so as to extend into the longitudinal passage 108 defined by the cores of the four central articles 22. Thereafter, another identical base tray is constructed and is placed over the cap tray with its article-receiving cavity facing upwardly. After the base tray is aligned with the cap tray, the operator then depresses tabs 104 and 106 of the base tray such that tabs 104 and 106 extend through the tab openings of the cap tray and into the article cores. This provides an interlock between the base tray, the cap tray and the articles in the lower layer to ensure proper alignment between adjacent layers of articles 22. The step of loading the tray is then repeated and another cap tray is placed over the loaded articles. This process is repeated as many times as desired.

The stacked layers are supported by a pallet or the like, and after as many layers as desired are stacked the pallet is carried to a wrapping machine for wrapping the entire periphery of the stacked layers and the pallet with a stretch-type film wrap, in accordance with conventional technology.

Various alternatives and embodiments are contemplated as being within the scope of the following claims particularly pointing out and distinctly claiming the subject matter regarded as the invention.

We claim:

1. A tray construction, comprising:

a bottom panel;

at least two side portions extending from the bottom panel, wherein each side portion defines at least one end;

wherein the side portions are foldable relative to the bottom panel to at least two fold positions such that at least a part of each side portion defines a side wall extending upwardly from the bottom wall, wherein the ends of the side portions are located adjacent each other when the side portions are folded relative to the bottom panel, wherein folding of the side portions to different fold positions varies the position of adjacent side portion ends relative to each other; and variable position retainer structure provided on the ends of the side portions for securing the folded side portions together when the side portions are folded, wherein the retainer structure is constructed and arranged so as to be engageable in at least two discrete engagement positions accommodating variations in the position of adjacent side portion ends when the side portions are folded to their at least two fold positions.

2. The tray construction of claim 1, further comprising at least two pre-formed fold lines associated with each side portion, wherein an inner one of the fold lines defines an outer edge of the bottom panel.

3. The tray construction of claim 2, wherein folding the side portion about an outer one of the fold lines results in the side portion between the inner and outer fold lines forming an extension of the bottom panel.

4. The tray construction of claim 1, wherein a first one of the side portions includes an extension formed integrally with and extending from the first side portion end, and wherein the retainer structure is interposed between the extension and a second one of the side portions.

5. The tray construction of claim 4, wherein the extension overlaps the second side portion, wherein the amount of overlap varies according to the fold position of the first and second side portions, and wherein the retainer structure comprises a tab and slot arrangement provided on the extension and the second side portion including at least one tab provided on one of the extension and second side portion, and at least two slots provided on the other of the extension and second side portion, wherein the tab is engaged with one of the slots when the first and second side portions are in either of the at least two fold positions.

6. The tray construction of claim 5, wherein the tab and slot arrangement comprises a tab formed on the extension, and a series of spaced slots formed in the second side portion toward its end.

7. The tray construction of claim 6, wherein the slots are laterally spaced from each other relative to a longitudinal axis defined by the second side portion.

8. The tray construction of claim 7, wherein the slots are spaced from each other relative to a transverse axis perpendicular to the longitudinal axis, wherein engagement of the tab within different ones of the slots varies the transverse position of the extension relative to the second portion for providing a visual indication of the folded position of the first and second side portions.

9. A tray construction, comprising:

a bottom panel;

at least two walls;

connecting structure interposed between the bottom panel and each wall, wherein the connecting structure is capable of being folded to at least two fold positions in which the wall extends upwardly from the bottom panel;

wherein the walls include end portions located adjacent each other in spaced relationship when the walls are folded upwardly by folding the connecting structure to one of its fold positions, wherein folding of the connecting structure to its different fold positions varies the spacing between the wall end portions; and variable position retainer structure for securing the wall end portions together when the walls are folded upwardly, wherein the retainer structure is constructed and arranged so as to be engagable in at least two discrete engagement positions for accommodating modating variations in spacing between the wall end portions when the connecting structure is folded to its at least two fold positions.

10. The tray construction of claim 9, wherein the connecting structure comprises a connector section interposed between and formed integrally with the bottom panel and each wall, and wherein the connector section includes at least two parallel linear demarcations defining the at least two fold positions of the connecting structure.

11. The tray construction of claim 10, wherein the connecting structure is capable of being folded to a fold position in which an inner portion of the connecting structure between the fold and the bottom panel is coplanar with the bottom panel.

12. The tray construction of claim 11, wherein the connecting structure is capable of being folded to a second fold position in which an outer portion of the connecting structure between the fold and the wall is coplanar with the wall.

13. The tray construction of claim 12, wherein the retainer structure comprises: an extension formed integrally with and extending from a first one of the walls, wherein the extension overlaps a second one of the walls and wherein the amount of overlap varies according to the fold position of the connecting structure interposed between the bottom panel and the first wall; a locking tab associated with the extension; and at least two openings formed in the second wall toward its end, wherein each opening is adapted to receive the locking tab when the second wall is folded to its various fold positions.

14. A method of constructing a tray, comprising the steps of:

providing a tray blank having a bottom panel with a series of side portions extending from the bottom panel, wherein each side portion defines a pair of ends;

folding the side portions upwardly relative to the bottom panel by folding each side portion at one of a plurality of fold locations, wherein each folded side portion defines a side wall and wherein the ends of adjacent side portions are placed in overlapping relationship when the side portions are folded to define the side walls;

wherein folding of the side portions at different ones of the fold locations functions to vary the height of the side walls and the amount of overlap of the side portion ends; and wherein the side portions include variable position retainer structure engageable in a plurality of discrete engagement positions;

interconnecting the overlapping ends of the adjacent side portions utilizing one of the plurality of discrete engagement positions of the variable position retainer structure, to secure the side walls together and to maintain the side walls in their folded positions.

15. The method of claim 14, wherein the end of a first one of the side portions includes an extension section which overlaps a second one of the side portions when the side portions are folded, and wherein the step of interconnecting the overlapping ends of the side portions is carried out by securing the extension section to the second side portion utilizing the variable position retainer structure.

16. The method of claim 15, wherein the variable position retainer structure includes a tab on the extension section and at least two spaced openings disposed toward the end of the second side portion; and wherein the step of securing the extension section to the second side position is carried out by engaging the tab within one of the openings according to the fold location of the first side portion.

17. The method of claim 15, wherein the tray blank is formed by providing a notch in the material of the tray blank between the ends of the first and second side portions, wherein a first edge of the notch defines a lower edge of the extension section when the second side portion is folded, and wherein a second edge of the notch borders the end of the first side portion.

* * * * *

UNITED STATES PATENT AND TRADEMARK OFFICE

CERTIFICATE OF CORRECTION

PATENT NO. : 5,624,031

DATED : April 29, 1997

INVENTOR(S) : JAMES L. FOWLER ET AL

It is certified that error appears in the above-identified patent and that said Letters Patent is hereby corrected as shown below:

In The Claims

Claim 9, col. 7, line 59, delete "modating".

Signed and Sealed this

Nineteenth Day of August, 1997

*Attest:*

*Attesting Officer*

Bruce Lehman

BRUCE LEHMAN

*Commissioner of Patents and Trademarks*